United States Patent [19]

Thorogood

[11] 4,414,094

[45] Nov. 8, 1983

[54] SOLVENT REFINED COAL REACTOR QUENCH SYSTEM

[75] Inventor: Robert M. Thorogood, Macungie, Pa.

[73] Assignee: International Coal Refining Company, Allentown, Pa.

[21] Appl. No.: 474,926

[22] Filed: Mar. 14, 1983

[51] Int. Cl.[3] ..... C10G 1/04

[52] U.S. Cl. ..... 208/8 LE

[58] Field of Search ..... 208/8 LE

[56] References Cited

U.S. PATENT DOCUMENTS 4,189,375 2/1980 Kirby et al. ..... 208/8 LE 4,325,800 4/1982 Rosenthal et al. ..... 208/8 LE

FOREIGN PATENT DOCUMENTS 2824062 12/1978 Fed. Rep. of Germany .

2062001 5/1981 United Kingdom .

*Primary Examiner*—Delbert E. Gantz

*Assistant Examiner*—Lance Johnson

*Attorney, Agent, or Firm*—Mark F. Wachter

[57] ABSTRACT

There is described an improved SRC reactor quench system using a condensed product which is recycled to the reactor and provides cooling by evaporation. In the process, the second and subsequent reactors of a series of reactors are cooled by the addition of a light oil fraction which provides cooling by evaporation in the reactor. The vaporized quench liquid is recondensed from the reactor outlet vapor stream.

8 Claims, 1 Drawing Figure

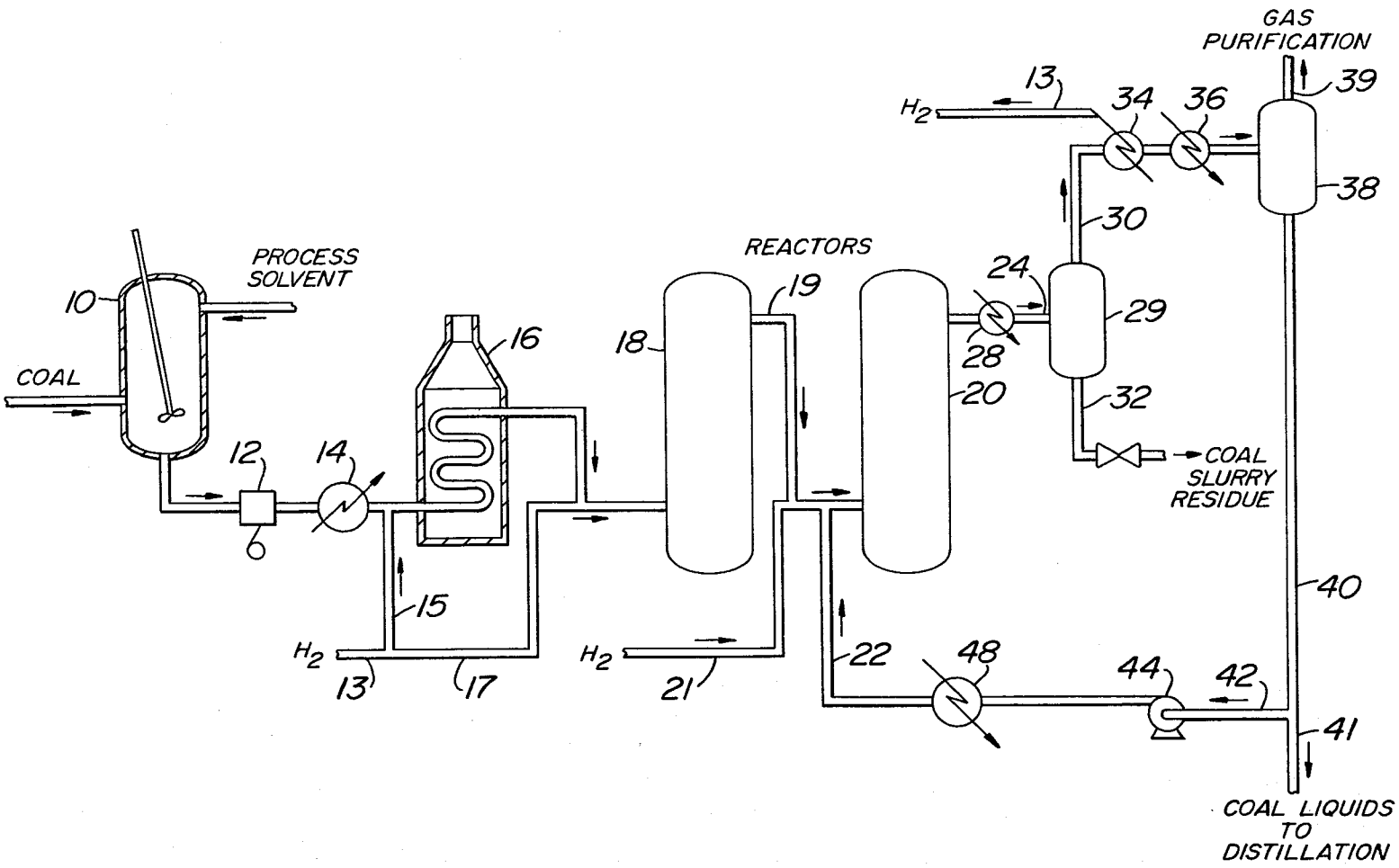
GAS PURIFICATION
39
38
40
41
COAL LIQUIDS TO DISTILLATION
36
34
30
29
32
COAL SLURRY RESIDUE
42
44
13
24
28
20
48
$H_2$
22
REACTORS
19
21
18
$H_2$
16
17
15
14
13
$H_2$
PROCESS SOLVENT
12
10
COAL

SOLVENT REFINED COAL REACTOR QUENCH SYSTEM

The Government of the United States of America has rights in this invention pursuant to Contract No. DE-AC05-78ORO3054 (as modified) awarded by the U.S. Department of Energy.

BACKGROUND OF THE INVENTION

This invention relates to a process for the solvent refining of coal wherein coal is liquefied by subjecting it to a hydrogen donor solvent (hereinafter referred to as "solvent") in the presence of a hydrogen-rich gas at elevated temperatures and pressures to produce solid and liquid products. This process is referred to in the art as SRC-I, solvent refined coal having the acronym "SRC".

In this process, following solvation, the products are separated into gaseous material, distillate fractions and vacuum distillation bottoms. The vacuum distillation bottoms, which contain entrained mineral matter and unconverted coal macerals, are separated in a deashing step. From the solids removal step there is recovered a stream of coal products which are free of ash minerals and unconverted coal and which are essentially low in sulfur content, such that this material is ideally suited for combustion in environmentally acceptable operations.

The SRC-I pilot plants at Wilsonville, Ala. and Fort Lewis, Wash. have been operated with a coal liquefaction reactor (also known as the dissolver) preceded by a preheater. The coal liquefaction reactions take place to some extent in both these vessels. A slurry of coal in recycled solvent under hydrogen pressure is passed through the preheater where its temperature is raised from ambient to a temperature in excess of 750° F. (398.9° C.). The heated slurry is passed to the reactor wherein the reaction of the hydrogen gas, the coal and the solvent take place at temperatures in excess of 780° F. (415.6° C.) and pressures in excess of 1,000 psia (70.3 kg/cm$^2$ a), the liquefaction reactions including desulfurization, solvent production, solvent rehydrogenation, etc. So long as hydrogen gas is present, the forward rate of reaction to produce asphaltenes and oils from dissolved coal is greater than the retrograde repolymerizations which lead to the formation of coke and preasphaltenes from the lower molecular products.

It is desirable to use a coal liquefaction reactor comprising at least two reactors (dissolvers) in series in order to maximize the ratio of asphaltene to preasphaltene in the product SRC. Also, while it is desirable to operate both reactors at the same temperature, the heat of reaction causes the second reactor in the series to operate at a higher temperature unless cooling is applied to the second reactor.

The conventional method of cooling in processes for the direct liquefaction of coal is by the addition of cold recycled hydrogen gas. A problem with this approach when applied in the SRC-I process is that the quantity of hydrogen required chemically for addition at the second reactor can only provide cooling equivalent of about 20° F. (11.1° C.), even when the hydrogen stream has been cooled to as low as 200° F. (93.3° C.). In a typical case, a cooling quantity of about 50° F. (27.8° C.) is required to achieve equal temperatures in the series reactors operating in the range of 825°-850° F. (440.6°-454.4° C.). Accordingly, this conventional method of cooling requires an extensive quantity of hydrogen resulting in high recycle equipment cost and high energy usage.

A second conventional method of cooling is by the direct cooling of the slurry flowing from the first reactor to the second reactor with a heat exchanger. This second method requires the use of very complex and expensive apparatus for achieving heat exchange between a high pressure three-phase gas-liquid-solid (hydrogen plus undissolved coal slurry) system and a suitable coolant (for example, cold recycle solvent).

SUMMARY OF THE INVENTION

It is the general object of the invention to provide an improved SRC reactor quench system by using a condensed product which is recycled to the reactor and provides cooling by evaporation. Briefly stated, the improved method of the invention uses direct cooling of the second reactor by the addition of a light oil fraction (boiling range at atmospheric pressure of approximately 350°-450° F., or 176.7°-232.2° C.) which will provide cooling by evaporation in the reactor. The vaporized quench liquid is recondensed from the reactor outlet vapor stream along with other products of the reaction and is cooled and recycled to the second reactor inlet. The quantity of quench fluid is minimized by this method and the additional equipment requirements comprise only additional surface in the reactor outlet vapor condenser and a quench recycle pump and cooler.

Thus, an advantage of the method of the invention over prior methods is the provision of a minimum material flow to achieve the cooling requirement by the utilization of a vaporizing quenching oil. This minimizes the energy requirements for the circulation of the quench fluid. A second advantage is that the process permits the use of lower cost conventional pump and heat exchange equipment without the need for slurry handling or hydrogen gas compression.

In the conventional method of cooling using recirculated hydrogen gas, it is necessary to provide a much larger mass flow of quench gas than of vaporizing quench oil of the invention, and this flow must be processed through the gas purification equipment comprising the stages of cooling, condensate removal, acid gas removal, cryogenic purification to remove hydrocarbons and recompression; all of this equipment requiring enlargement to process the additional flow and substantial power for gas recompression.

In the second conventional method of cooling described above, which requires cooling of a three phase stream at high pressure and temperature, expensive materials are required to withstand corrosion/erosion at the operating conditions and difficult problems of equipment design are encountered in obtaining satisfactory flow distributions.

BRIEF DESCRIPTION OF THE DRAWING

The single FIGURE in the drawing shows a schematic flow diagram of the preferred embodiment of the invention.

DETAILED DESCRIPTION OF THE PREFERRED EMBODIMENT

Feed coal, typically finely crushed bituminous coal, is mixed with recycle solvent in a slurry mix tank 10 in a coal:solvent ratio of about 1:1 to about 1:3. A typical ratio is 1:1.6. The coal-solvent slurry from tank 10 is passed to a pumping unit 12 that pumps the slurry up to a pressure in the range of 1000–3000 psia (70.3–210.9 kg/cm$^2$ a), typically 2300 psia (161.7 kg/cm$^2$ a). The pressurized slurry is heated to an intermediate temperature of about 500° F. (260° C.) by a heat exchanger 14 wherein, typically, a heated recycle solvent is passed in heat exchange relationship with the slurry. The heated slurry is combined with a first portion of the hydrogen gas stream via line 15. The three-phase gas-slurry stream is then introduced into a preheater system comprised of an externally heated tubular reactor 16. The three-phase mixture is heated to the reaction temperature in the preheater 16, this temperature being about 780° F. (415.6° C.). The second portion of the hydrogen gas stream is added to the preheated slurry via line 17 and the mixture is passed to a first coal liquefaction vessel 18. This first vessel is a bubble column adiabatic reactor vessel as is conventional in the art.

In the first reactor vessel 18, exothermic hydrogenation of the coal produces an increased temperature in the range of 825°–850° F. (440.6°–454.4° C.). The products from the first reactor 18 flow to a second reactor vessel 20 via a line 19. Additional cold hydrogen at about 200° F. (93.3° C.) is passed to the second reactor vessel 20 via line 21 to give a ratio of hydrogen to feed coal of about 10,000 to 40,000 scf/per ton (290 to 1,160 Nm$^3$ per metric ton).

In accordance with the improved process of the invention, recycled cold quench oil is added to the feed to the second reactor 20 via a line 22 in sufficient quantity to maintain the temperature of the effluent from the second reator 20 approximately equal to the temperature of the effluent from the first reactor 18 in the range of 825°–850° F. (440.6°–454.4° C.). The preferred quantity of quench oil to feed coal will be in a ratio ranging from 0.08 to 0.25:1. More broadly the reactor temperature can range from about 750°–880° F. (398.9°–471.1° C.) and the liquid hourly space velocity (LHSV) may range from 1 to 5 hour$^{-1}$.

The reactor products are removed via line 24 and may be partially cooled by means of heat exchanger 28 to a temperature in the range of 760° to 850° F. (404° to 454° C.) and separated in a vessel 29 into a vapor fraction containing vaporized light oil and gases (for example, $H_2$, $NH_3$, $H_2S$, $H_2O$, and $C_1$–$C_4$ fuel gases) which are removed via line 30 and a slurry fraction (coal slurry residue) which is removed via line 32. The slurry is further processed to separate solvent refined coal, recycle solvent and ash residue by methods conventional in the art.

The vapor fraction is initially cooled in a heat exchanger 34 against recycle hydrogen which is heated close to the reactor effluent temperature before recycling to the process through line 13. The vapor fraction is then further cooled in heat exchanger 36 to a temperature in the range of 400° to 450° F. (204.4° to 232.2° C.). The resulting two-phase mixture is separated in phase separator 38 into light gases (for example, $H_2$, CO, $NH_3$, $H_2S$, $H_2O$, $CO_2$ and $C_1$–$C_4$ fuel gases), which are passed to further purification stages via line 39, and a condensed liquid fraction comprised primarily of light oils (atmospheric boiling point less than approximately 450° F., or 232.2° C.).

A portion of the condensed fraction is then passed via lines 40 and 42 to the quench recycle pump 44. The remaining portion, which consists primarily of net products of coal liquefaction contained in the vapor effluent from the coal reactor, is passed to further distillation via a line 41.

The flow of recycle quench oil from pump 44 is cooled in quench cooler 48 to a temperature in the range of 200°–300° F. (93.3°–148.9° C.) before recycling to the second reactor vessel inlet via line 22 as discussed previously.

It will be appreciated that the above description is schematic and recites the essential operation of the process and that those skilled in the art will know where to supply and how to employ the necessary valves, pumps, pressure equipment and other standard engineering elements required in the system.

What is claimed is:

1. In a process for the solvent refining of coal wherein a slurry of finely ground coal in process solvent is passed through a preheater to a coal liquefaction stage in the presence of hydrogen rich gases at elevated temperatures and pressures, the improvement wherein said coal liquefaction stage comprises at least two reactors in series and operated at approximately the same temperature, the second and subsequent reactors being cooled by using a process-derived condensed product which is recycled thereto and provides cooling by evaporation.

2. A process according to claim 1 wherein the second and subsequent reactors are cooled by recycled cold quench oil which is added to the feeds to the reactors in sufficient quantities to maintain the temperature of the effluent from the reactor approximately equal to the temperature of the effluent from the preceding reactor and in the range of 750°–880° F. (398.9°–471.1° C.) at a pressure above 1000 psia (70.3 kg/cm$^2$ a).

3. The process according to claim 1 wherein the reactor products are removed from the final reactor and separated into a vapor fraction containing light oils and gases and a slurry fraction, said slurry fraction is further processed to separate solvent refined coal, recycle solvent and ash residues, and a portion of said vapor fraction is at least partially condensed with the resulting condensed liquid fraction being further cooled and then passed to the feed line to the second and subsequent reactors for cooling the same.

4. The process according to claim 1 wherein the second and subsequent reactors are cooled by the addition of a quench liquid including light oils having an atmospheric boiling temperature range of approximately 350°–450° F. (176.7°–232.2° C.).

5. The process according to claim 4 wherein said quench liquid is recondensed from the reactor outlet vapor stream and is cooled and recycled to the inlet of the second and subsequent reactors.

6. The process according to claim 5 wherein the quantity of quench liquid to feed coal is a ratio ranging from about 0.08–0.25:1.

7. The process according to claim 6 wherein the quench liquid is cooled to a temperature in the range of 200°–300° F. (93.3°–148.9° C.) before recycling to the second reactor inlet.

8. The process according to claim 5 wherein the quench liquid is cooled to a temperature in the range of 200°–300° F. (93.3°–148.9° C.) before recycling to the second reactor inlet.

* * * * *